US005266965A

United States Patent [19]

Komai et al.

[11] Patent Number: 5,266,965

[45] Date of Patent: Nov. 30, 1993

[54] METHOD OF DRIVING INK JET TYPE PRINTING HEAD

[75] Inventors: Hiromichi Komai; Tomoaki Nakano, both of Yokohama; Toshio Inada, Sagamihara; Toshitaka Hirata, Tokyo, all of Japan

[73] Assignee: Ricoh Company, Ltd., Tokyo, Japan

[21] Appl. No.: 863,702

[22] Filed: Apr. 3, 1992

[30] Foreign Application Priority Data

| | | | |
|---|---|---|---|
| Apr. 5, 1991 | [JP] | Japan | 3-101857 |
| Jun. 21, 1991 | [JP] | Japan | 3-177133 |
| Feb. 13, 1992 | [JP] | Japan | 4-059520 |

[51] Int. Cl.[5] ..... B41J 2/045; B41J 2/055

[52] U.S. Cl. ..... 346/1.1; 346/140 R

[58] Field of Search ..... 346/140 R, 1.1; 310/317

[56] References Cited

U.S. PATENT DOCUMENTS

| | | | |
|---|---|---|---|
| 4,251,823 | 2/1981 | Sagae | 346/140 R |
| 4,300,144 | 11/1981 | Isayama et al. | 346/140 R |
| 5,142,296 | 8/1992 | Lopez et al. | 346/1.1 |

FOREIGN PATENT DOCUMENTS

| | | |
|---|---|---|
| 59-176060 | 10/1984 | Japan . |
| 62-56150 | 3/1987 | Japan . |
| 2-24218 | 5/1990 | Japan . |

*Primary Examiner*—Benjamin R. Fuller
*Assistant Examiner*—Alrick Bobb
*Attorney, Agent, or Firm*—Cooper & Dunham

[57] ABSTRACT

A method of driving an ink jet type printing head is applied to a printing head which has a plurality of channels, a plurality of nozzles provided on ends of the channels and a plurality of piezoelectric elements for varying volumes of the channels in response to driving voltages so as to eject ink from each nozzle having a corresponding channel the volume of which is reduced by a corresponding one of the piezoelectric elements. The method includes the steps of applying a first driving voltage to a first group of piezoelectric elements and a second driving voltage to a second group of piezoelectric elements, and controlling a phase of at least one of the first and second driving voltages so that a predetermined phase difference exists between the first driving voltage and the second driving voltage.

16 Claims, 15 Drawing Sheets

METHOD OF DRIVING INK JET TYPE PRINTING HEAD

BACKGROUND OF THE INVENTION

The present invention generally relates to methods of driving ink jet type printing heads, and more particularly to a method of driving an ink jet type printing head so that the printing quality is greatly improved at a low cost using the ink jet printing head which has a relatively simple construction.

A known ink jet type printing head is provided with a piezoelectric element, and the ink is ejected when the piezoelectric element is activated. According to the so-called on-demand type ink jet printing system which controls the ink ejecting pressure, an electrical signal is applied to the printing head, and this electrical signal is converted into pressure waves by the piezoelectric element so that the ink is ejected by the pressure waves. This on-demand type printing system generates pressure pulses depending on the electrical signal, and thus, has advantages in that a driving circuit having a simple construction can be used. Examples of the on-demand type ink jet printing systems are disclosed in the Japanese Published Patent Application No. 2-24218 and the Japanese Laid-Open Patent Application No. 62-56150.

The Japanese Published Patent Application No. 2-24218 proposes a method of driving the on-demand type ink jet printing head. A driving voltage pulse in the same direction as the polarization voltage is applied in advance to the piezoelectric element to accumulate a charge and reduce the volume of a pressure chamber. When ejecting the ink, the charge is gradually discharged to increase the volume of the pressure chamber, and a pulse is thereafter applied again to quickly accumulate a charge and reduce the volume of the pressure chamber so as to eject the ink. Hence, the printing head can be driven by an inexpensive driving circuit, and the ink can be ejected by use of a relatively low driving voltage. However, no consideration is given as to the mutual interference introduced in a multi-nozzle printing head, and there is no teaching with regard to controlling the phase of the driving voltages applied to the nozzle parts of the printing head.

On the other hand, the Japanese Laid-Open Patent Application No. 59-176060 proposes to provide electrodes for applying first and second voltages and to contract a side wall part when expanding an actuator part. But this arrangement requires additional electrodes to be formed and an additional driving circuit. Furthermore, there is no teaching with regard to controlling the phase of the driving voltages applied to the nozzle parts of the printing head.

Therefore, there is a demand to realize a method of driving the ink jet type printing head, which enables stable ejection of the ink and suppresses deviation in the ejection velocity of the ink with respect to the driving frequency. Further, it is also desirable to realize a method which prevents deterioration of the ink ejection velocity caused by mutual interference of the nozzles of the multi-nozzle printing head when the nozzles are simultaneously driven.

SUMMARY OF THE INVENTION

Accordingly, it is a general object of the present invention to provide a novel and useful method of driving an ink jet type printing head, in which the problems described above are eliminated and the above described demands are satisfied.

Another and more specific object of the present invention is to provide a method of driving an ink jet type printing head which has a plurality of channels, a plurality of nozzles provided on ends of the channels and a plurality of piezoelectric elements for varying volumes of the channels in response to driving voltages so as to eject ink from each nozzle having a corresponding channel the volume of which is reduced by a corresponding one of the piezoelectric elements, comprising the steps of (a) applying a first driving voltage to a first group of piezoelectric elements and a second driving voltage to a second group of piezoelectric elements, and (b) controlling a phase of at least one of the first and second driving voltages so that a predetermined phase difference exists between the first driving voltage and the second driving voltage. According to the method of the present invention, it is possible to reduce the peak current when driving all of the channels, because the piezoelectric elements are not all activated at the same time. Furthermore, it is possible to reduce the noise which is generated when the piezoelectric elements deform the channels.

If the phase difference between the first and second driving voltages is small, the drive of the odd channels and the release of the even channels do not overlap, and the effect of suppressing the mutual interference of the odd channels is not extremely large. However, since the sneak phase of the pressure waves from the odd channels and the phase of the pressure waves generated in the even channels match, the effect of suppressing the mutual interference of the even channels is large.

If the phase difference between the first and second driving voltages is large, the sneak phase of the pressure waves from the odd channels and the phase of the pressure waves generated in the even channels do not match, and the effect of reducing the mutual interference of the even channels is reduced.

However, the mutual interference of the odd and even channels is suppressed and improved in a region in which the first and second driving voltages have the phase difference. The mutual interference can further be suppressed by applying to the piezoelectric elements the first driving voltage and the second driving voltage which have different pulse waveforms.

Other objects and further features of the present invention will be apparent from the following detailed description when read in conjunction with the accompanying drawings.

DESCRIPTION OF THE PREFERRED EMBODIMENTS

Figure 1:
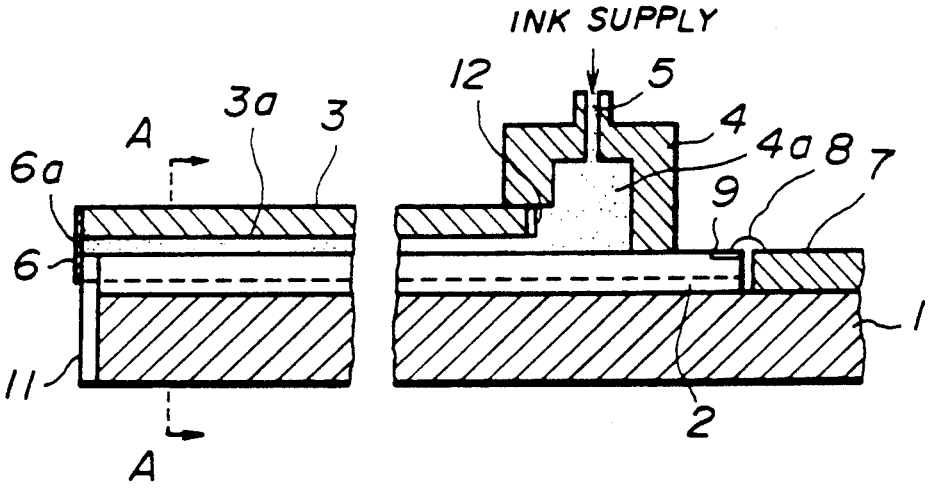
FIG. 1 is a cross sectional view showing an embodiment of an ink jet type printing head employed in a first embodiment of the present invention.
Figure 2:
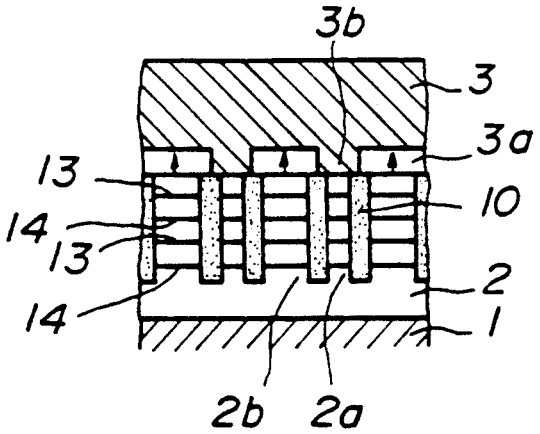
FIG. 2 is a cross sectional view showing the ink jet type printing head along a line A—A in FIG. 1.

FIG. 1 shows a cross sectional view of an embodiment of an ink jet type printing head employed in a first embodiment of the present invention, and FIG. 2 shows a cross section of the ink jet type printing head along a line A—A in FIG. 1.

In FIGS. 1 and 2, the printing head includes a substrate 1, piezoelectric elements 2 including a non-driven piezoelectric element 2*a* and a driven piezoelectric element 2*b*, a channel plate 3, ink channels 3*a*, wall parts 3*b*, a common chamber forming member 4, a common chamber 4*a*, an ink supply pipe 5, a nozzle plate 6, nozzles 6*a*, a printed circuit board (PCB) 7 for driving, lead wires 8, driving electrodes 9, grooves 10 filled by a filler, a protection plate 11, a fluid resistance 12, and electrodes 13 and 14.

A mechanical process such as a dicing saw process is carried out with respect to the stacked piezoelectric elements 2 so as to form the grooves 10 in the direction in which the channels 3*a* extend. As a result, the piezoelectric elements 2 having the electrodes 13 and 14 are sectioned into the grooves 10, the driven piezoelectric element 2*b* and the non-driven piezoelectric element 2*a*. The filler fills the grooves 10. The channel plate 3 connects to the piezoelectric elements 2 which have the grooves 10. In other words, the piezoelectric elements 2 and the channel plate 3 are supported by the non-driven piezoelectric element 2*a* and the wall parts 3*b* which extend between two adjacent channels 3*a*.

The ink channel 3*a* is formed by a glass etching process, a mechanical process such as a dicing saw process, or a resin molding process. The width of the driven piezoelectric element 2*b* is slightly narrower than the width of the channel 3*a*.

When a driving voltage in the form of a pulse is applied to the driven piezoelectric element 2*b* which is selected by a driving circuit of the PCB 7, the driven piezoelectric element 2*b* is deformed in the direction along the thickness thereof and the volume of the channel 3*a* changes. As a result, pressure waves are generated within the ink channel 3*a*, and the ink is ejected from the nozzle 6*a* of the nozzle plate 6. The nozzle 6*a* may be formed by a glass or metal etching process, an electroforming process, a laser resin forming process and the like.

The following Table 1 shows the specifications of this embodiment of the printing head.

TABLE 1

| | |
|---|---|
| Substrate 1: | Stainless steel, Thickness = 1 mm |
| Piezoelectric Element 2: | P-7B by MURATA Company Limited<br>Thickness = 1 mm<br>Stacked structure with 50 μm × 6 layers<br>Width of Element 2b: 118 μm<br>Width of Element 2a: 70 μm<br>Width of Groove 10: 40 μm<br>Depth of Groove 10: 500 μm |
| Channel Plate 3: | PEG3 by HOYA Company Limited<br>Thickness = 1 mm<br>Width of Channel 3a: 198 μm<br>Height of Channel 3a: 100 μm<br>Length of Channel 3a: 16 to 26 mm |
| Nozzle Plate 6: | PEG3 by HOYA Company Limited<br>Thickness = 1 mm<br>Diameter of Nozzle 6a: 45 μm<br>Number of Nozzles 6a: 32 |
| Filler: | XN1024/XN1129 by CIBA-GEIGY (Japan ) Limited |

Figure 3:
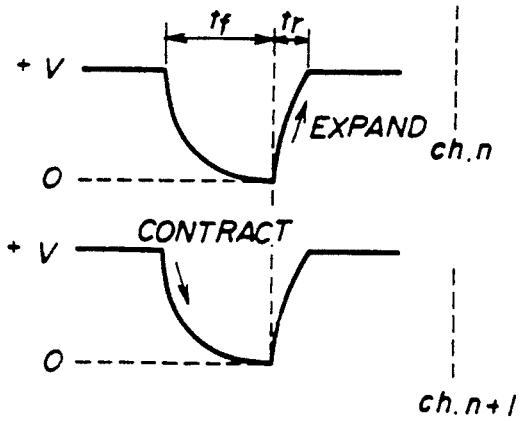
FIG. 3 shows a waveform of a driving voltage.

FIG. 3 shows the waveform of the driving voltage. A bias voltage (+V) is constantly applied to the driven piezoelectric element 2*b*, and the driven piezoelectric element 2*b* is expanded thereby in the direction in which the ink channel 3*a* extends. When ejecting the ink, the driven piezoelectric element 2*b* contracts within a time tf and expands within a time tr so as to generate the pressure waves within the ink channel 3*a*.

Figure 4A:
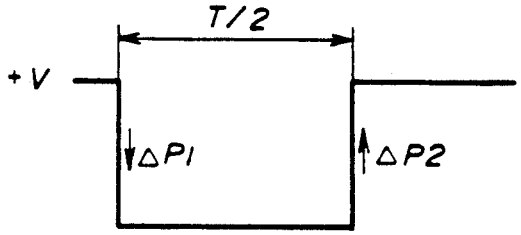
FIG. 4A shows a model driving voltage and a pressure generation state.
Figure 4B:
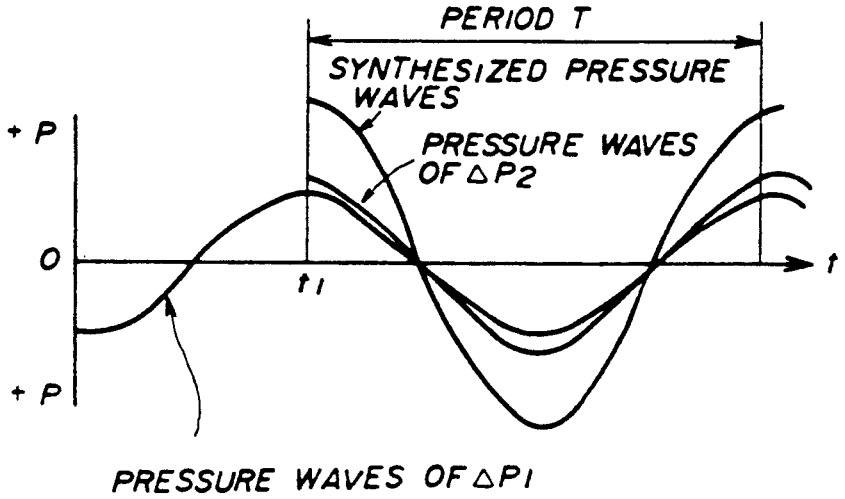
FIG. 4B is a diagram for explaining an overlapping effect of pressure waves within a channel corresponding to a driven piezoelectric element.

FIG. 4A shows the driving voltage and the pressure generation state when the driving system described above is employed, and FIG. 4B shows a diagram for explaining an overlapping effect of the pressure waves within the channel 3*a* corresponding to the driven piezoelectric element 2*b*.

In the contraction and expansion process of the piezoelectric element 2, a negative pressure (ΔP1) and a positive pressure (ΔP2) are generated channel 3*a*. The pressure waves overlap within the channel 3*a*. The pressure waves overlap within the channel 3*a*, and as a result, the ink is ejected at a velocity which corresponds to the amplitude of the synthesized pressure waves at a time $t=t_1$. Accordingly, if the period of the pressure waves is denoted by T, the velocity of the ejected ink becomes a maximum value when the pulse width of the applied driving voltage is set equal to T/2.

If the speed of sound within the ink is denoted by C and the length of the channel 3*a* is denoted by L, it was found that the period T of the pressure waves is approximately equal to 2L/C. For example, T=40 μs if L=22 mm, and T=32 μs if L=18 mm, where C=1100 m/s.

Figure 5:
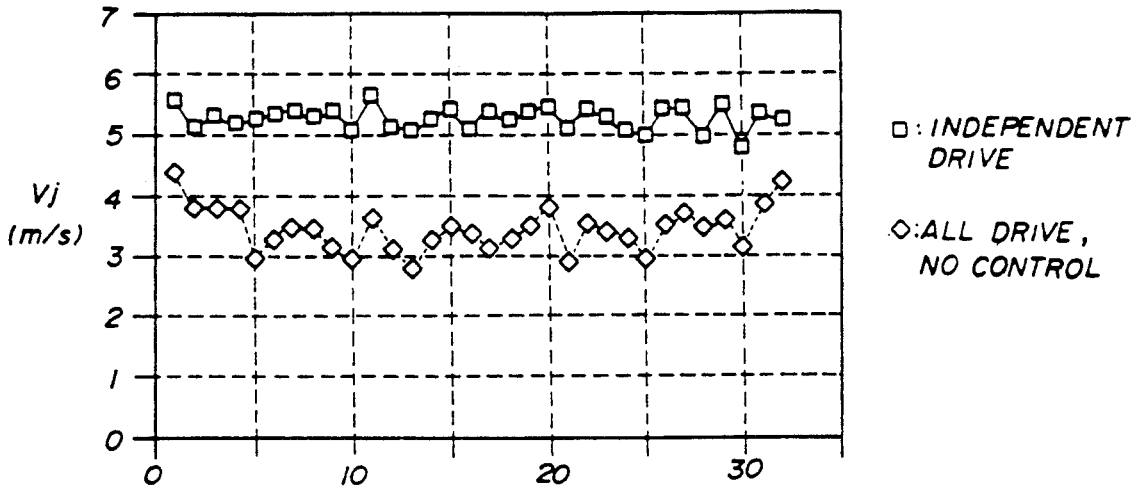
FIG. 5 shows deterioration of the ink ejection velocity caused by mutual interference of nozzles.

FIG. 5 shows a deterioration of the ink ejection velocity caused by mutual interference of the nozzles. FIG. 5 shows the ink ejection velocity for the case where each channel is driven independently and the ink ejection velocity for the case where all of the channels are driven simultaneously in a multi-nozzle head having 32 channels. In this case, the length L of the ink channel 3*a* is 22 mm, the applied driving voltage Vp is 22.5 V, and the driving frequency F is 1 kHz. As may be seen from FIG. 5, the deterioration of the ink ejection velocity is greater for the case where all of the channels are driven simultaneously as compared to the case where each channel is driven independently. Under a printing condition such that the independent driving of each channel and the driving of all of the channels are repeated, the accuracy of the dot positions on the recording sheet becomes poor due to the change in the ink ejection velocity, and the image quality is deteriorated thereby.

Figure 6:
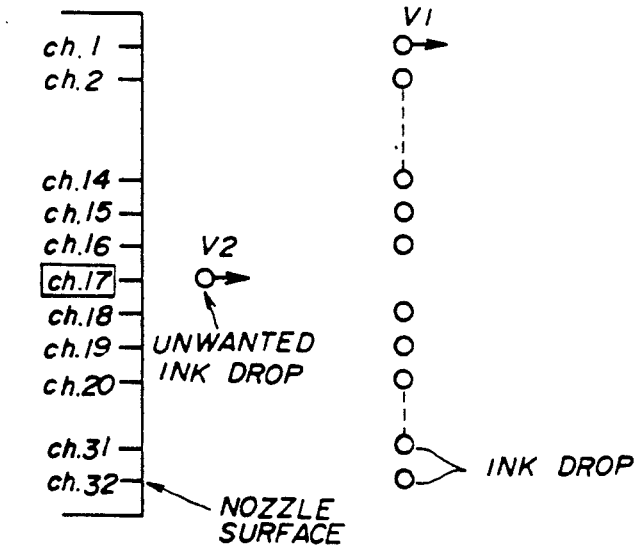
FIG. 6 shows ejection of unwanted ink from a non-driven nozzle due to the mutual interference.

FIG. 6 shows the ejection of unwanted ink from the non-driven nozzle due to the mutual interference. FIG. 6 shows a vicinity of a nozzle surface for a case where only a channel ch17 of the 32-channel head is not driven and all the other channels are driven. As shown, the unwanted ink which should originally not be ejected from the channel ch17 is ejected at a low ink ejection velocity and causes the image deterioration. If the ink ejection velocity of the unwanted ink is extremely slow, the unwanted ink accumulates in the vicinity of the nozzle surface, and it becomes difficult to eject the ink in a normal manner when the channel ch17 is next driven.

Figure 7A:
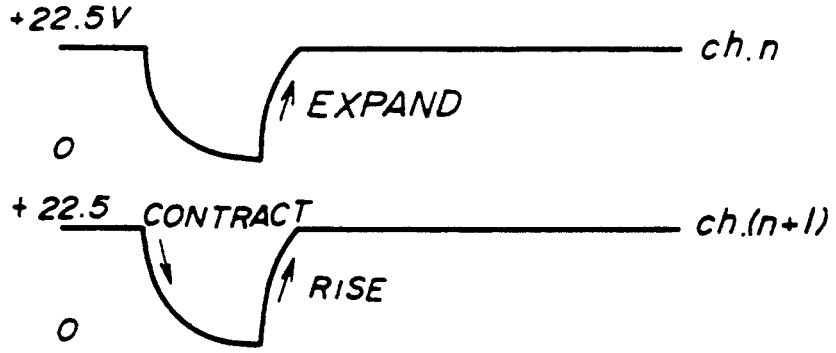
FIG. 7A and 7B are diagrams for explaining the cause of the mutual interference.
Figure 7B:
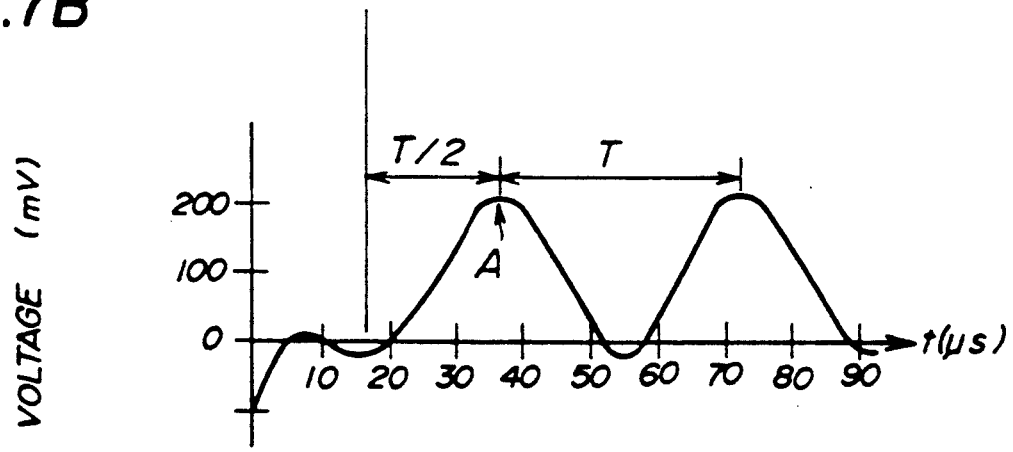

FIG. 7 is a diagram for explaining the mutual interference. For the sake of convenience, it is assumed that the driving condition is the same as that of FIGS. 5 and 6 described above and that driving voltages having the same waveform and the same phase are applied to each of the channels.

In FIG. 7, (a) shows the driving voltage waveform, and (b) shows the pressure waves within the channel ch17 when only the channel ch17 is not driven. The pressure waves shown in (b) of FIG. 7 are obtained by monitoring the voltage level at the non-driven piezoelectric element 2*a* in a state where the bias voltage applied to the non-driven piezoelectric element 2*a* is removed (that is, dropped to the ground level), and is equivalent to detecting the pressure within the channel 3*a* due to the piezoelectric effect of the non-driven piezoelectric element 2*a*. For example, the voltage output of 100 mV is approximately 1.5 kg/cm$^2$ in pressure, and it may be seen that a large pressure exists within the channel 3*a*.

The pressure waves within the channel 3*a* of the non-driven piezoelectric element 2*a* reach a peak value approximately a time t=T/2 after the driving voltage applied to the driven piezoelectric element 2*b* starts to rise, and an attenuation vibration having a period T is observed thereafter. This means that the channel plate 3 is pushed upwardly in the direction of the arrow in FIG. 2 when the applied driving voltage rises and the driven piezoelectric element 2*b* expands, and that as a result, the pressure waves are generated within the channel 3*a* of the non-driven piezoelectric element 2*a*.

In FIGS. 1 and 2, the filler which fills the groove 10 has a Young's modulus which is as small as possible. But this filler does not prevent the wall part 3*b* of the channel plate 3 from being displaced upwardly when the piezoelectric element 2 expands. In addition, when an adhesive agent is used to connect the piezoelectric element 2 and the channel plate 3, the adhesive agent which swells out also causes displacement of the wall part 3*b*.

Figure 8:
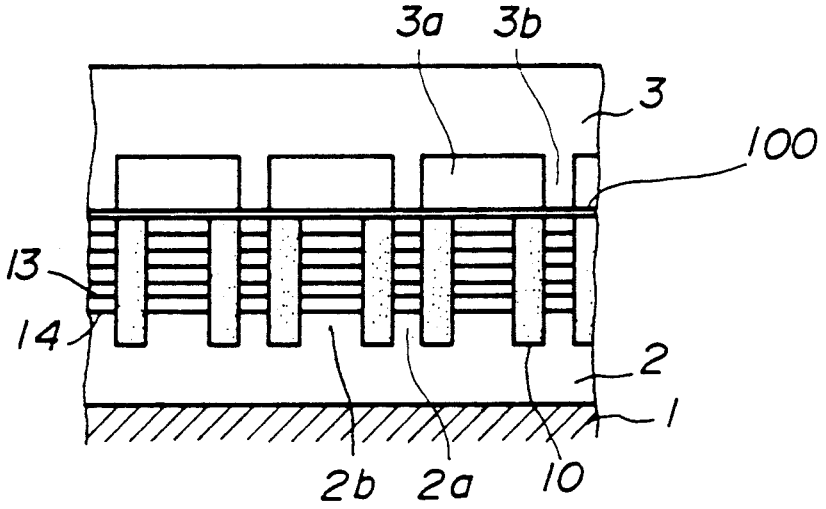
FIG. 8 is a cross sectional view showing another embodiment of the ink jet type printing head employed in the first embodiment of the present invention.

FIG. 8 shows another embodiment of the ink jet type printing head used in the first embodiment of the present invention. In FIG. 8, those parts which are basically the same as those corresponding parts in FIGS. 1 and 2 are designated by the same reference numerals, and a description thereof will be omitted.

In FIG. 8, the piezoelectric elements 2 and the channel plate 3 are connected via a vibration plate 100. For example, this vibration plate 100 is made of polyphenylene sulfide (PPS) and has a thickness of 6 to 20 μm. When this vibration plate 100 is provided, it is possible to omit the filler which was used to fill the grooves 10 in the printing head shown in FIGS. 1 and 2. According to this printing head shown in FIG. 8, the channel 3*a* is deformed via the vibration plate 100 when the driven piezoelectric element 2*b* expands, and it was found that the mutual interference occurs similarly as in the case of the printing head shown in FIGS. 1 and 2.

When the channel plate 3 is displaced, the ink ejection velocity deteriorates due to the reduced pressure increase within the channels 3*a* when all of the channels are driven as compared to the case where each channel is driven independently. In addition, the ejection of unwanted ink occurs due to a peak A of the pressure within the channel 3*a*, where this peak A is shown in (b) of FIG. 7. Moreover, a velocity change occurs due to a driving frequency change if the time of the driving voltage next to the driving frequency change matches the peak or bottom of the pressure waves.

Figure 9:
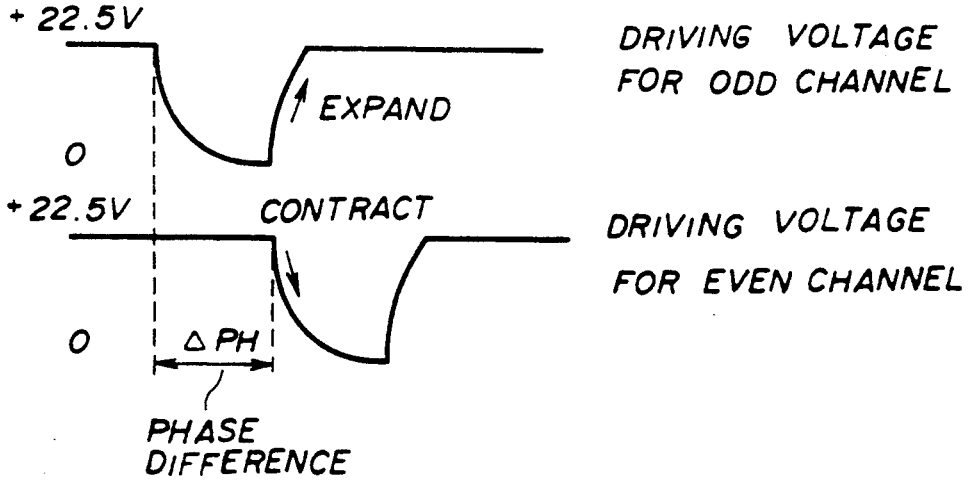
FIG. 9 shows waveforms of driving voltages having a phase difference.

FIG. 9 shows the waveforms of driving voltages having a phase difference. In other words, the piezoelectric elements 2 are divided into two groups, namely, a group of odd channels and a group of even channels, and the driving voltage applied to the piezoelectric elements 2 of the odd channels and the driving voltage applied to the piezoelectric elements 2 of the even channels have a phase difference so that the rising edge of the driving voltage for the odd channels match the falling edge of the driving voltage for the even channels.

Figure 10:
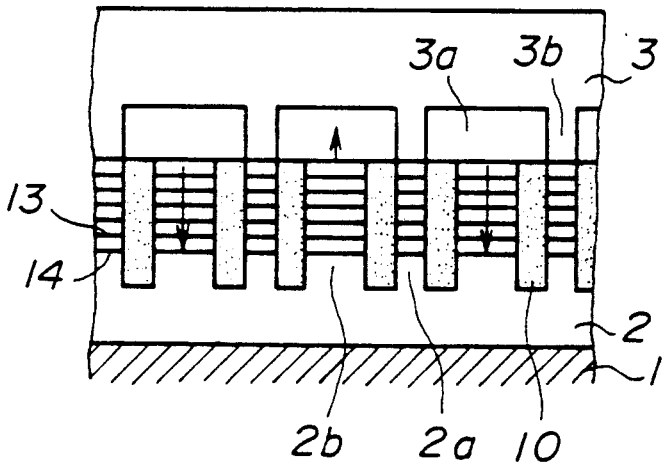
FIG. 10 is a cross sectional view showing the printing head show in FIG. 8 in a state where driving voltages having a phase difference is applied to the piezoelectric elements of the odd and even channels.

When the odd channel is observed under the above described condition, the even channel which is adjacent to the odd channel contracts while the odd channel expands, and it is possible to prevent the deformation of the channel plate 3 compared to the case where the applied driving voltages have no phase difference. For this reason, the deterioration of the ink ejection velocity due to the mutual interference of the odd channels is suppressed and improved. FIG. 10 shows the printing head shown in FIG. 8 in the above described state.

On the other hand, when the even channels expand, at least the deformation of the piezoelectric elements 2 of the odd channels will not affect the operation of the even channels. The mutual interference may occur when every other channels amounting to one-half of all of the channels are driven simultaneously, however, the phase of the pressure waves generated within the channels of the non-driven piezoelectric elements 2 shown in FIG. 7 and the phase of the pressure waves generated when the piezoelectric elements 2 of the even channels expand are added. As a result, it was found that the mutual interference is greatly reduced compared to the case where all of the channels are driven by the driving voltages having no phase difference.

Figure 11:
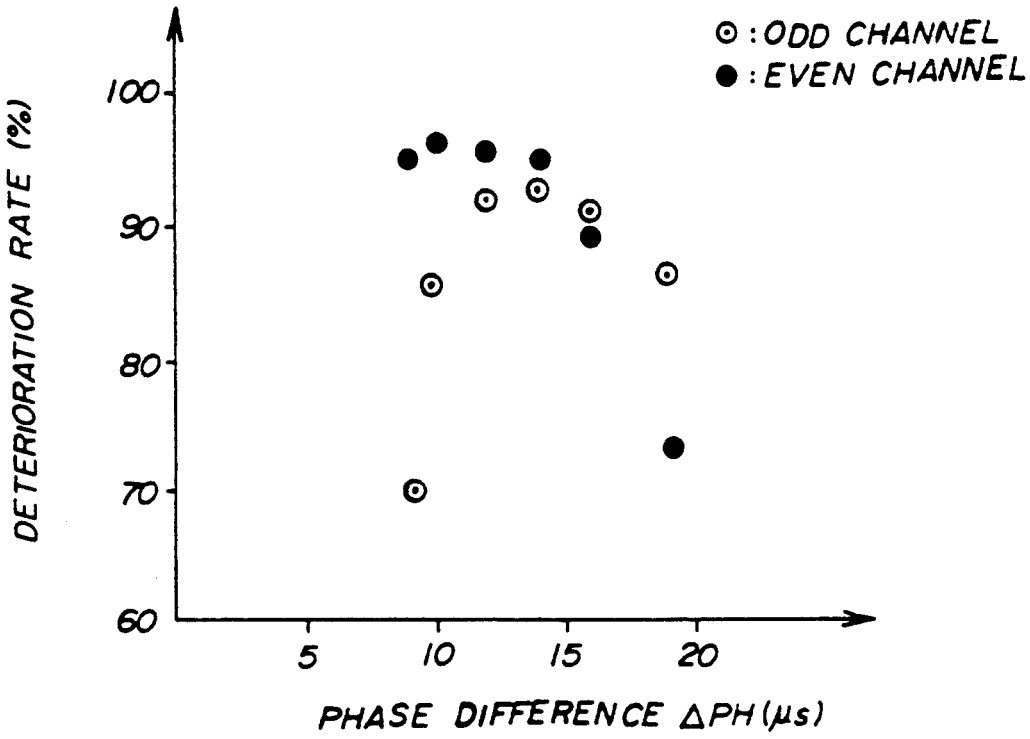
FIG. 11 is a diagram for explaining a deterioration rate of the ink ejection velocity due to the mutual interference.

Next, a description will be given of the deterioration rate of the ink ejection velocity due to the mutual interference when the phase of the driving voltage for the even channels is changed relative to the phase of the driving voltage for the odd channels, by referring to FIG. 11 and the following Table 2. For the sake of convenience, it is assumed that the length L of the channel 3*a* is 18 mm and the driving voltage Vp is 25 V.

TABLE 2

| μm | PH = 0 | PH = 8 | PH = 10 | PH = 12 | PH = 14 | PH = 16 | PH = 19 |
|---|---|---|---|---|---|---|---|
| Odd Ch. | 69.8 | 69.8 | 85.8 | 92.0 | 92.8 | 91.3 | 86.8 |
| Even Ch. | 69.8 | 95.2 | 96.5 | 95.6 | 94.8 | 89.4 | 73.3 |

The deterioration rate of the ink ejection velocity due to the mutual interference is defined by the ratio of the ink ejection velocity at the time when all of the 32 channels are driven simultaneously with respect to the ink ejection velocity at the time each channel is driven independently. Although the odd channels and the even channels behave differently with respect to the change in the phase difference, it may be seen that there exists a phase difference at which the deterioration rate of the ink ejection velocity is small for both the odd channels and the even channels.

Next, a description will be given of the first embodiment of the method according to the present invention, in which the odd channel and the even channels are driven by driving voltages having a phase difference.

Figure 12:
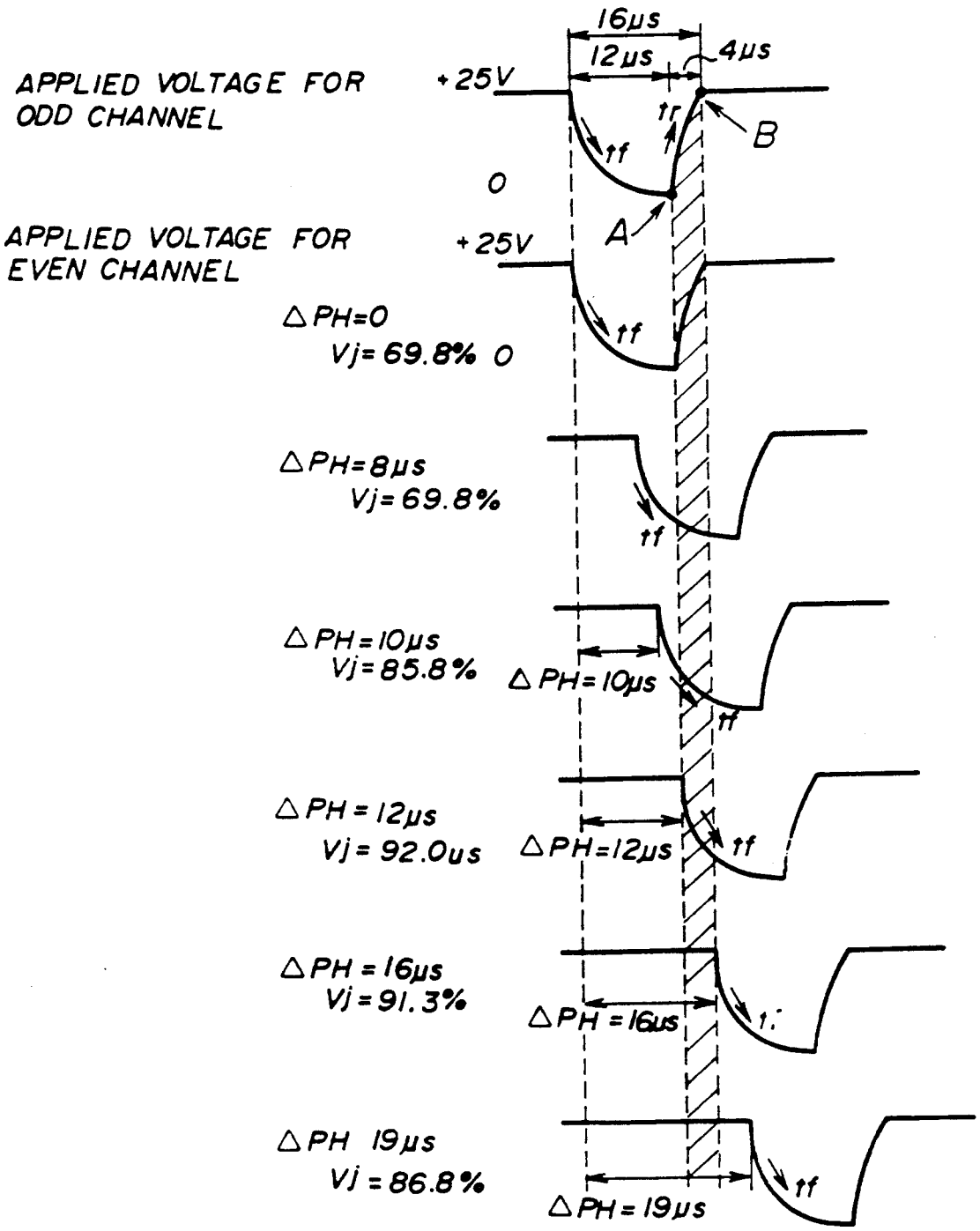
FIG. 12 shows waveforms of driving voltages for explaining phase control of the driving voltages applied to piezoelectric elements of odd channels.

First, a description will be given of the phase control of the driving voltage with respect to the odd channels, by referring to FIG. 12. A driving voltage is applied to a reference odd channel for 16 μs, that is, for the times tf and tr. If the length L of the channel 3*a* is 18 mm and the period T of the pressure waves is 32 μs, the ink ejection velocity becomes a maximum when the pulse width of the driving voltage is T/2=16 μs. FIG. 12 shows the driving voltage applied to this reference odd channel, and the driving voltages which have the same waveform as the driving voltage applied to the reference odd channel but with a different phase and are applied to the even channels. Hence, FIG. 12 shows the relationship of the rising time tr of the driving voltage with respect to the reference odd channel and the falling time tf of the driving voltages with respect to the even channels, and also shows the deterioration rate of the ink ejection velocity due to the mutual interference of the odd channel.

If the time at which the driving voltage applied to the even channel rises occurs within the rising time (that is, between points A and B) of the driving voltage applied to the odd channel, the deterioration rate of the ink ejection velocity due to the mutual interference of the odd channel is small. This indicates that the deformation of the channel plate 3 when the piezoelectric element 2 of the odd channel expands is suppressed by the rise in the driving voltage applied to the piezoelectric element 2 of the even channel, as may be seen from FIG. 10.

Figure 13:
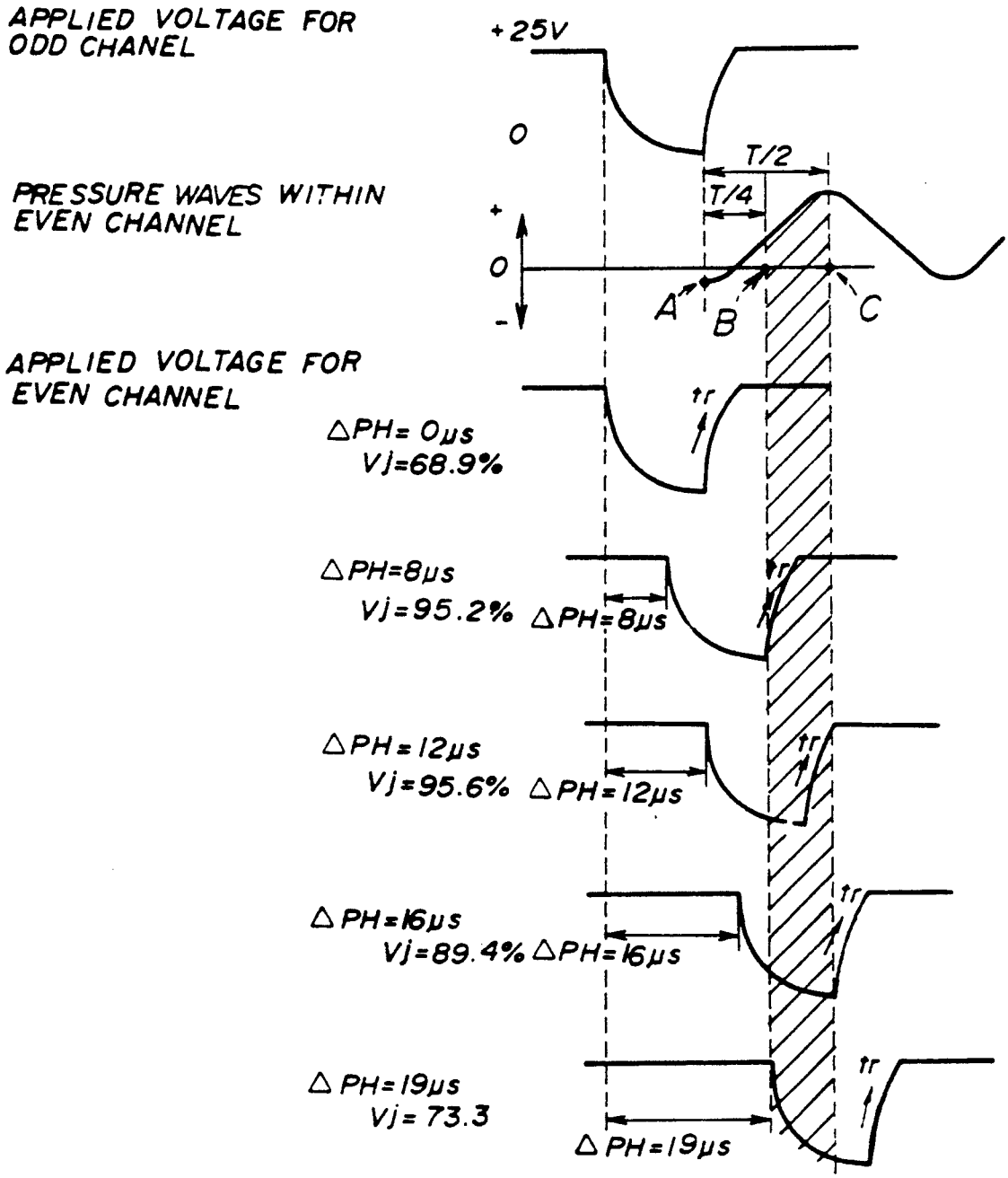
FIG. 13 shows waveforms of driving voltages for explaining phase control of the driving voltages applied to piezoelectric elements of even channels.

Next, a description will be given of the phase control of the driving voltage with respect to the even channels, by referring to FIG. 13. As explained above with respect to the driving of the piezoelectric elements of the odd channels with reference to FIG. 7, the pressure waves generated within the even channels have a peak at a time t=T/2 from the time (point A) when the rise of the driving voltage applied to the odd channel starts. When the phase of the driving voltage with respect to the even channel changes, the deterioration rate of the ink ejection velocity due to the mutual interference of the even channel is small and satisfactory if the time at which the rise of the driving voltage with respect to the even channel starts within a range of t=T/4 to T/2 (that is, between points B and C) from the point A. This indicates that the mutual interference of the even channel is reduced within a region in which the pressure waves generated when the driving voltage with respect to the even channel rises and the pressure waves generated when driving the odd channel overlap and intensify each other.

Therefore, by driving the piezoelectric elements in the groups of odd and even channels using the driving voltages which have an appropriate phase difference, the mutual interference is greatly suppressed. Of course, this effect of suppressing the mutual interference, however, slight differs depending on the construction of the printing head, that is, differs between the printing heads shown in FIGS. 1 and 2 and FIGS. 8 and 10, for example.

Figure 14A:
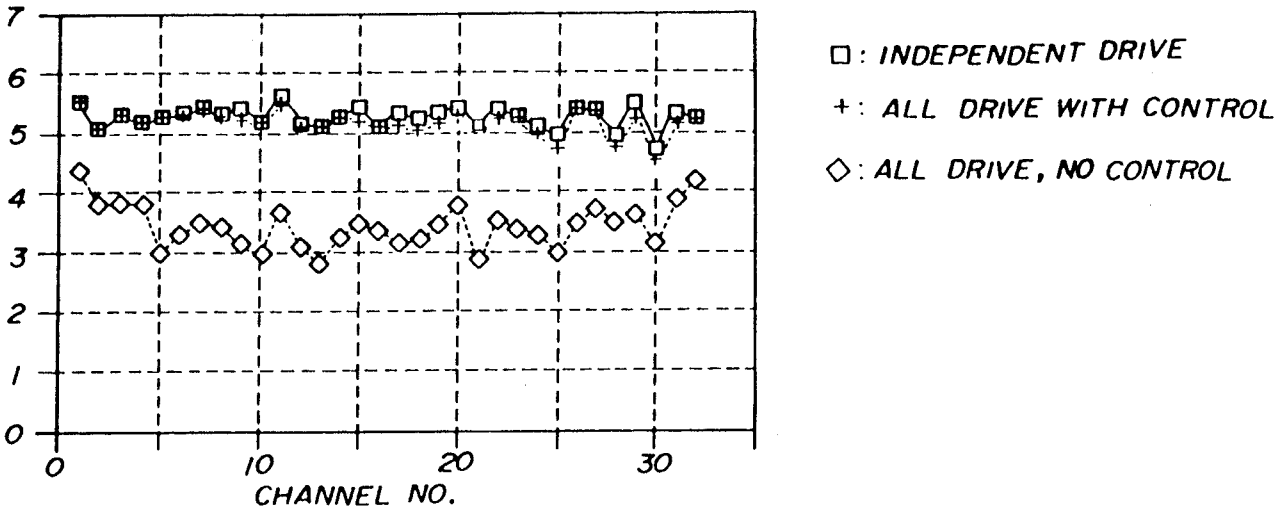
FIGS. 14A and 14B are diagrams for explaining the effect of preventing deterioration of the ink ejection velocity using the driving voltages having the phase difference.
Figure 14B:
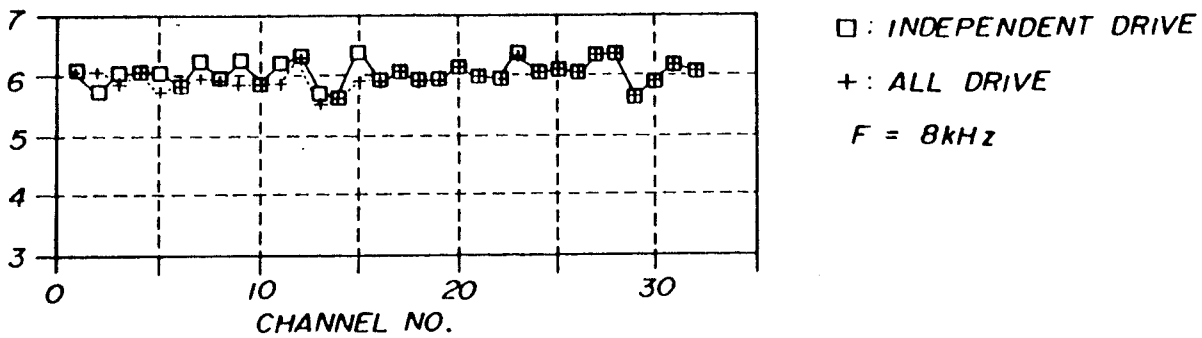

FIGS. 14A and 14B are diagrams for explaining the effect of preventing deterioration of the ink ejection velocity using the driving voltages having the phase difference. FIG. 14A shows the results obtained under the same condition used in FIG. 5, and FIG. 14B shows the results obtained for a different printing head when the driving voltage frequency F is 8 kHz and the length L of the channel 3*a* is 22 mm. As may be seen from FIGS. 14A and 14B, the deterioration of the ink ejection velocity is greatly suppressed and improved when all of the channels are driven using the phase control of the driving voltages from the low frequency region of the driving voltage up to the high frequency region of the driving voltage.

Figure 15A:
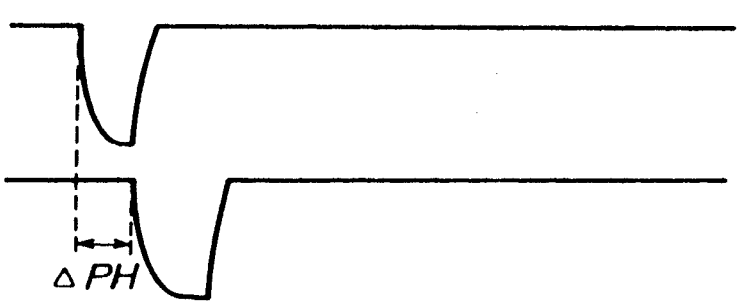
FIGS. 15A and 15B are diagrams for explaining the effect of preventing ejection of unwanted ink from the non-driven nozzle.
Figure 15B:
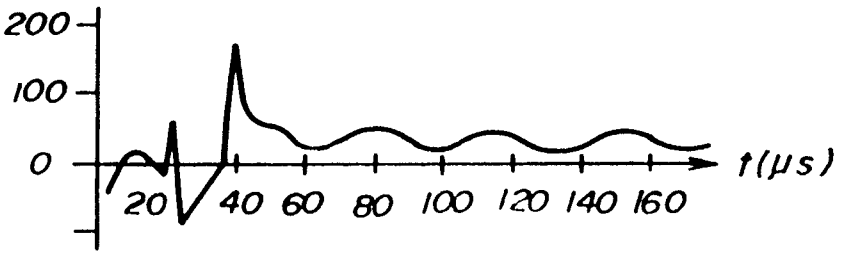

FIG. 15 is a diagram for explaining the effect of preventing ejection of unwanted ink from the non-driven nozzle, under the same condition as that for FIG. 7. In FIG. 15, (a) shows the waveforms of the driving voltages applied to the piezoelectric elements 2 of the odd and even channels, and (b) shows the pressure waves within the non-driven channel. As may be seen from FIG. 15, the pressure waves within the non-driven channel are greatly reduced, and no ejection of unwanted ink occurs.

Figure 16B:
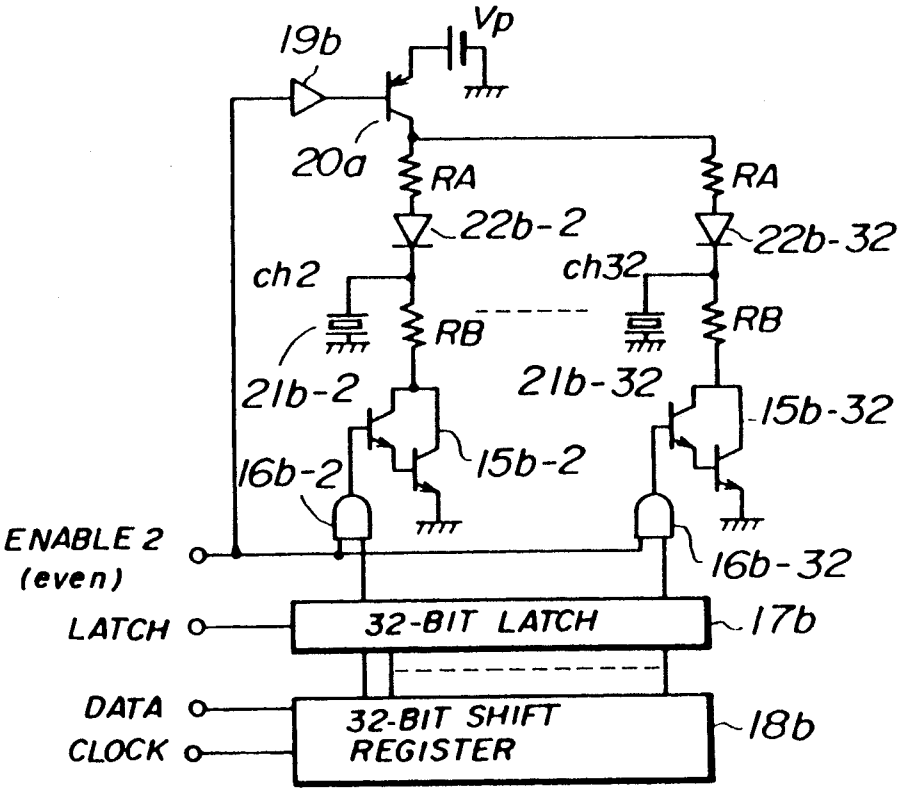
FIGS. 16A and 16B respectively are circuit diagrams showing embodiments of phase control circuits for the odd and even channels.
Figure 16A:
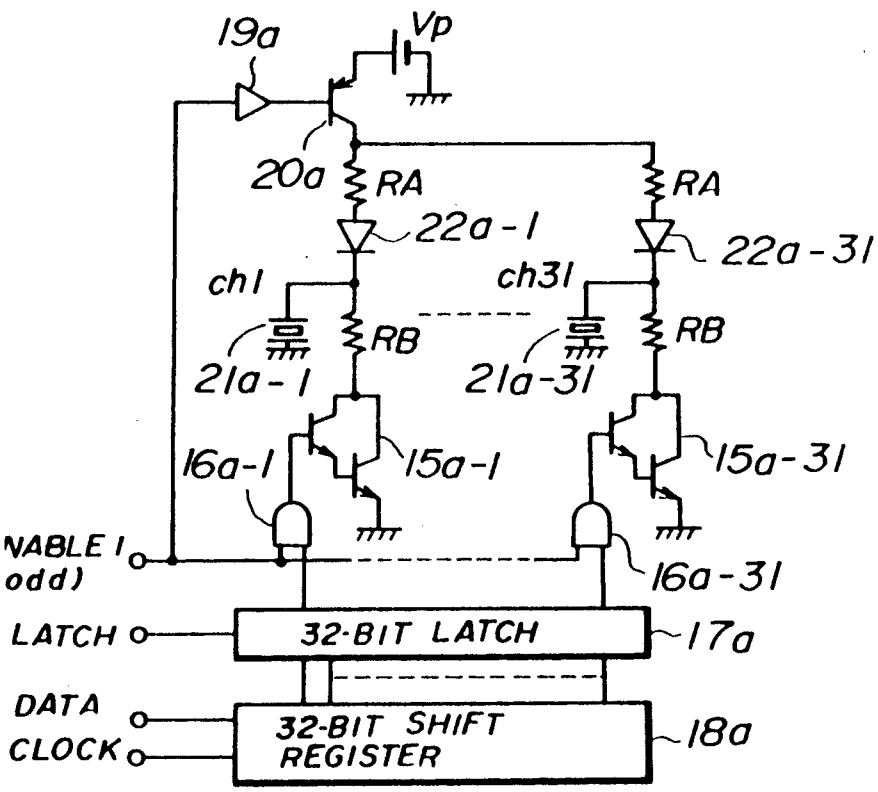
Figure 17:
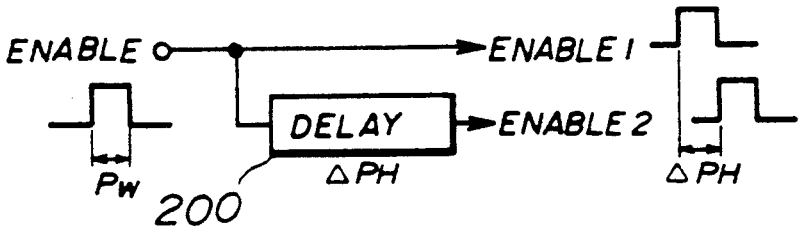
FIG. 17 shows a circuit for generating first and second enable signals in FIGS. 16A and 16B.
Figure 18:
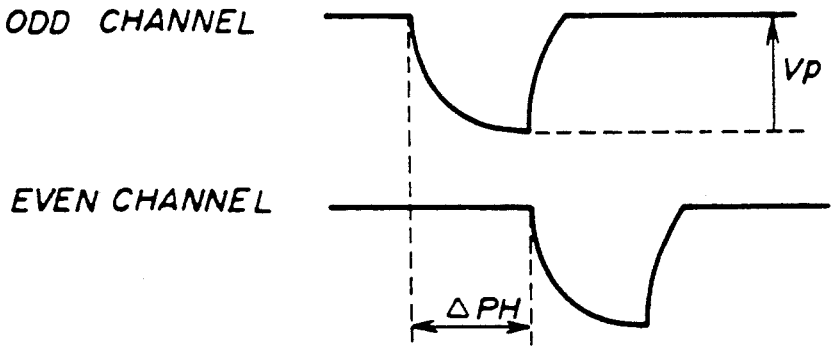
FIG. 18 shows signal waveforms within the circuits shown in FIGS. 16A and 16B.

FIGS. 16A and 16B respectively show embodiments of phase control circuits for the odd and even channels. In addition, FIG. 17 shows a circuit for generating first and second enable signals, and FIG. 18 shows the signal waveforms within the circuits shown in FIGS. 16A and 16B.

The phase control circuit shown in FIG. 16A includes NPN transistors 15*a*-1 through 15*a*-31, AND circuits 16*a*-1 through 16*a*-31, a 32-bit latch circuit 17*a*, a 32-bit shift register 18*a*, a buffer 19*a*, a PNP transistor 20*a*, PZTs 21*a*-1 through 21*a*-31, and diodes 22*a*-1 through 22*a*-31 which are connected as shown. On the other hand, the phase control circuit shown in FIG. 16B includes NPN transistors 15b-2 through 15b-32, AND circuits 16b-2 through 16b-32, a 32-bit latch circuit 17b, a 32-bit shift register 18b, a buffer 19b, a PNP transistor 20b, PZTs 21b-2 through 21b-32, and diodes 22b-2 through 22b-32 which are connected as shown.

The data (DATA), the latch signal (LATCH) and the clock (CLOCK) are used in common for the two phase control circuits shown in FIGS. 16A and 16B.

The 32-channel driver is divided into two groups, namely, one group of odd channels and another group of even channels. The PZTs 21a-1 through 21a-31 of each channel is coupled to a charge circuit which is made up of the PNP transistor 20a, the buffer 19a, a charging resistor $R_A$ and the diodes 22a-1 through 22a-31, and to a discharge circuit which is made up of the NPN transistors 15a-1 through 15a-31, the AND circuits 16a-1 through 16a-31, the latch circuit 17a and the shift register 18a. On the other hand, the PZTs 21b-2 through 21b-32 of each channel is coupled to a charge circuit which is made up of the PNP transistor 20b, the buffer 19b, a charging resistor $R_A$ and the diodes 22b-2 through 22b-32, and to a discharge circuit which is made up of the NPN transistors 15b-2 through 15b-32, the AND circuits 16b-2 through 16b-32, the latch circuit 17b and the shift register 18b. The PNP transistors 20a and 20b and the buffers 19a and 19b are used in common for the 16 channels. In other words, one PNP transistor and one buffer are provided for the group of odd channels and also for the group of even channels.

The PZTs 21a-1 through 21a-31 and 21b-2 through 21b-32 of each channel are charged to the power source voltage Vp by the respective charge circuits. The data signals are converted into 32-bit parallel data by the shift registers 18a and 18b, and are respectively input to the AND circuits 16a-1 through 16a-31 and to the AND circuits 16b-2 through 16b-32 based on the timing of a latch signal. For the odd channels, when a first enable signal ENABLE1 has a high level in FIG. 16A, only the NPN transistors 15a-1 through 15a-31 of the charge circuit corresponding to the channel for which the latched output has a high level turn ON, and the charges charged in the PZTs 21a-1 through 21a-31 are discharged to the ground via a discharge resistor $R_B$. The discharged PZTs 21a-1 through 21a-31 are again charged to the power source voltage Vp via the charging resistor $R_A$ when the level of the first enable signal ENABLE1 becomes low because the PNP transistor 20a of the charge circuit turns ON.

On the other hand, for the even channels, a second enable signal ENABLE2 supplied to the phase control circuit 16B is delayed by a time ΔPH compared to the first enable signal ENABLE1. As shown in FIG. 17, an enable signal ENABLE is used as it is as the first enable signal ENABLE1, but the enable signal ENABLE is delayed by the time ΔPH in a delay circuit 200 and output as the second enable signal ENABLE2. For this reason, compared to the NPN transistors 15a-1 through 15a-31 of phase control circuit shown in FIG. 16A provided for the odd channel, the NPN transistors 15b-2 through 15b-32 turn ON with a time delay ΔPH and then the discharging of the PZTs 21b-2 through 21b-32 takes place.

Accordingly, as shown in FIG. 18, the rise in the driving voltage waveform for the even channel is delayed by the time ΔPH compared to the rise in the driving voltage waveform for the odd channel. On the other hand, the pulse width of the driving voltages is determined by a pulse width Pw of the enable signal ENABLE.

In the embodiment described above, the nozzles (or channels) of the multi-nozzle printing head are divided into two groups, and the two groups are driven by driving voltages (pulses) having a phase difference so as to suppress the deterioration of the ink ejection velocity caused by the mutual interference. But in the ink jet type printers, it is necessary to vary the ink drop diameter and the mass of the ejected ink depending on the desired resolution and printing speed. In this case, the frequency characteristic change of the ink drop diameter and the mass of the ejected ink becomes large when the shape of the ink chamber 4a, the length of the ink chamber 4a in particular, changes.

As a result, it is necessary to vary the length of the ink chamber 4a depending on the desired ink drop diameter and the mass of the ejected ink.

Next, a description will be given of a second embodiment of the present invention. When the length of the ink chamber 4a changes, the first embodiment of the present invention in which the phase of the driving voltages is controlled may not satisfactorily suppress the mutual interference of the two groups of channels when all of the channels (nozzles) are driven simultaneously, and the deterioration of the ink ejection velocity may not become as satisfactory as shown in FIGS. 14A and 14B.

The effect of preventing deterioration of the ink ejection velocity due to the mutual interference of the odd channels is obtained by contracting the piezoelectric element of the even channel while the piezoelectric element of the odd channel expands, as described above. For this reason, the effect of preventing the deterioration of the ink ejection velocity differs depending on the construction which affects the mutual interference, such as the use of the filler in FIG. 2 and the provision of the vibration plate 100 shown in FIG. 8, that is, the degree of deformation of the channel plate 3.

On the other hand, the effect of preventing the deterioration of the ink ejection velocity caused by the mutual interference of the even channels is obtained by matching the time at which the peak value of the pressure waves which are generated when the odd channel is driven occurs and the time at which the even channel is driven. In addition, the time at which the peak value of the pressure waves occurs is $t=T/2$ which is one-half the period T of the pressure waves determined by the length of the channel 3a.

Figure 19:
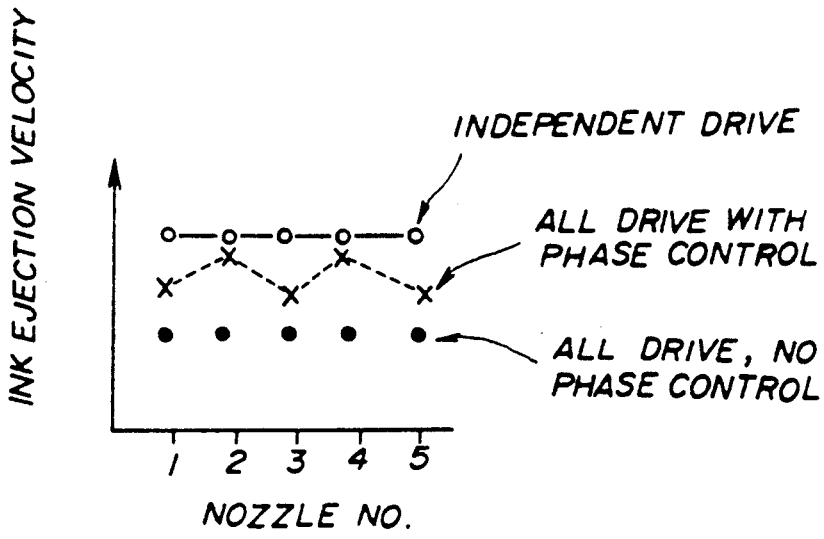
FIGS. 19 and 20 shows examples where the effect of preventing the deterioration of the ink ejection velocity by use of the phase control is different between the odd and even channels.
Figure 20:
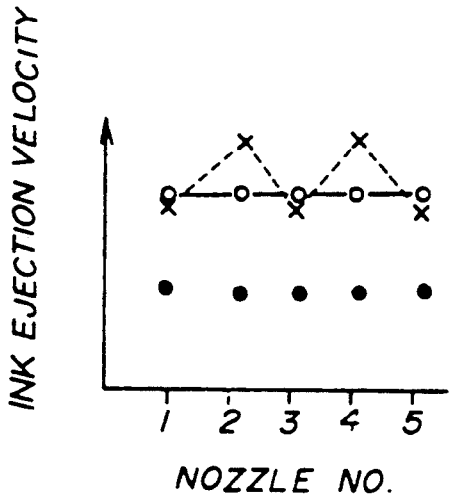

Therefore, when the driving voltage waveforms for the odd and even channels are the same, the effect of preventing the deterioration of the ink ejection velocity in the odd and even channels as shown in FIGS. 14A and 14B is not necessarily obtained always, depending on the connection between the piezoelectric elements and the channel plate, the length of the ink chamber determined by the mass and velocity of the ink, and the like. FIGS. 19 and 20 show examples where the effect of preventing the deterioration of the ink ejection velocity by use of the phase control is different between the odd and even channels.

In this embodiment, the driving voltage waveforms supplied to the two groups of channels (or nozzles) are made different in order to eliminate the above described problem in which the effect of preventing the deterioration of the ink ejection velocity by use of the phase control becomes different between the odd and even channels.

In this embodiment, the relationship between the driving voltage waveforms (pulses) and the ink ejection velocity is as follows:

Peak value Vp: Ink ejection velocity is higher for larger Vp;

Pulse width Pw: A Pw exists which makes the ink ejection velocity a maximum;

Fall time tf: Ink ejection velocity is higher for smaller tf; and

Rise time tr: Ink ejection velocity is higher for smaller tr.

First, a description will be given of the case where the mutual interference shown in FIG. 19 is corrected. For the sake of convenience, it is assumed that the reference group is made up of the odd nozzles (channels), and the phase of the driving voltage is shifted for the other group made up of the even nozzles (channels).

Figure 21:
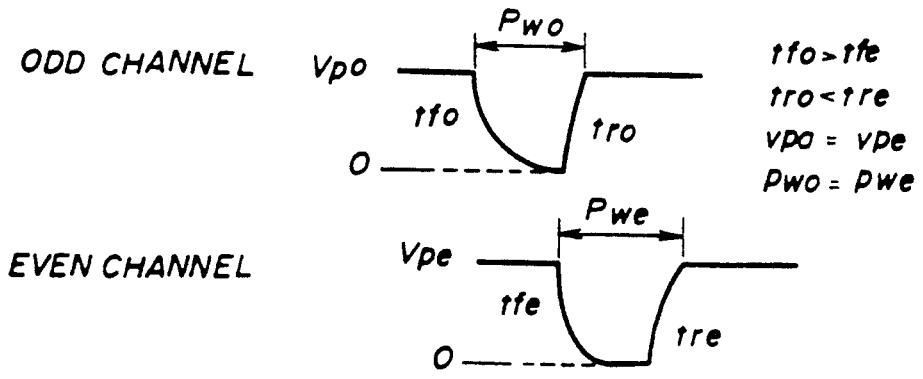
FIGS. 21 through 23 show driving voltage waveforms for explaining methods of applying driving voltages having different waveforms to two groups of channels.

Compared to the case where the driving voltages for the two groups are the same, the fall time tfe of the driving voltage for the odd nozzle becomes small as shown in FIG. 21 and the acceleration of the contraction of the piezoelectric element corresponding to the even nozzle increases. As a result, the ink ejection velocity of the odd nozzle increases. On the other hand, the rise time tre of the driving voltage for the even nozzle is increased by the amount the fall time tfe decreases to increase the ink ejection velocity, so as to decrease the ink ejection velocity and mutually cancel the effect on the even nozzle.

Figure 22:
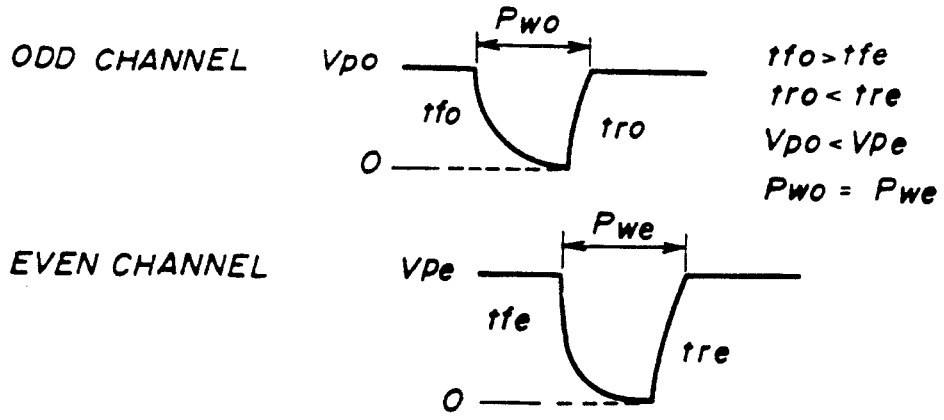

Compared to the case where the driving voltages for the two groups are the same, the fall time tfe of the driving voltage for the odd nozzle becomes small as shown in FIG. 22, and because the peak value Vpe is large, the acceleration of the contraction and the amount of deformation of the piezoelectric element corresponding to the even nozzle becomes large, thereby increasing the ink ejection velocity of the odd nozzle. On the other hand, the rise time tre of the driving voltage for the even nozzle is increased to mutually cancel the amount of increase of the ink ejection velocity caused by the change in the fall time tfe and the peak value Vpe.

Next, a description will be given of the case where the mutual interference shown in FIG. 20 is corrected.

Figure 23:
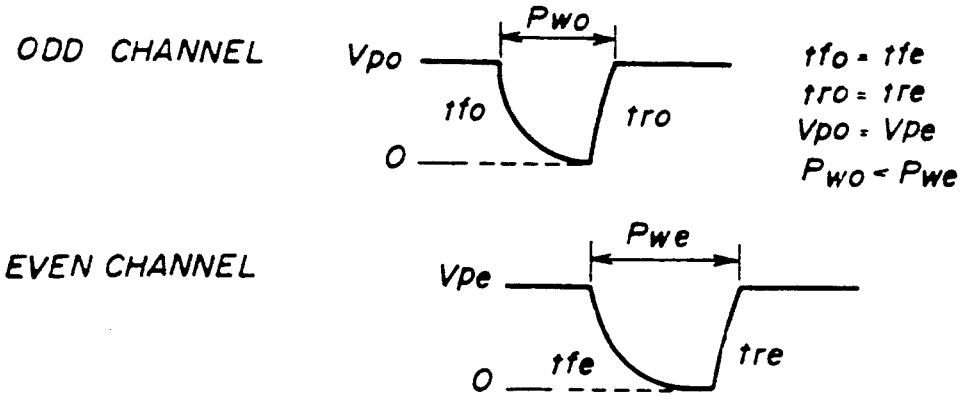

As shown in FIG. 23, the driving voltage for the odd nozzle does not change. On the other hand, since the pulse width Pwe of the driving voltage for the even nozzle is large, the ink ejection velocity decreases due to the phase difference of the pressure waves generated in the even nozzle and the pressure waves generated from the odd nozzle. Although the ink ejection velocity may change due to a change in the pulse width Pw of the driving voltage when independently driving each nozzle, the change in the ink ejection velocity caused by the change in the pulse width Pw when independently driving each nozzle is extremely gradual. For this reason, the mutual interference shown in FIG. 20 can be corrected within the range of the pulse width Pw in which the ink ejection velocity virtually remains unchanged.

Although the above description explains the correction of the cases shown in FIGS. 19 and 20, the mutual interference may not necessarily occur as shown in FIGS. 19 and 20. However, it is possible to correct the mutual interference of the printing head having an arbitrary construction by changing the driving voltage waveforms based on the pattern of the mutual interference when all of the nozzles are driven simultaneously.

In addition, when driving all of the channels by the driving voltages having the controlled phases, the activation times of the odd and even channels do not overlap. As a result, it is possible to suppress the peak current of the driving circuit to a low value when activating the odd and even channels, and at the same time, it is possible to reduce the noise which is generated when the piezoelectric elements are deformed.

Further, the present invention is not limited to these embodiments, but various variations and modifications may be made without departing from the scope of the present invention.

What is claimed is:

1. A method of driving an ink jet type printing head which has a plurality of channels, a plurality of nozzles provided on ends of the channels and a plurality of piezoelectric elements for varying volumes of the channels in response to driving voltages so as to eject ink from each of said plurality of nozzles having a corresponding channel, a volume of which is reduced by a corresponding one of the piezoelectric elements, said method comprising the steps of:

(a) applying a first driving voltage to a first group of piezoelectric elements and a second driving voltage to as second group of piezoelectric elements; and (b) controlling a phase of at least one of the first driving voltage and second driving voltage so that a predetermined phase difference exits between the first driving voltage and the second driving voltage;

wherein said step (b) sets the predetermined phase difference such that the second driving voltage starts to fall within a rise time of the first driving voltage.

2. The method of driving the ink jet type printing head as claimed in claim 1, wherein the first group of piezoelectric elements act on every other one of said channels and the second group of piezoelectric elements act on remaining channels, so that each one of said channels driven by the piezoelectric elements of the first group is adjacent to the remaining channels driven by the piezoelectric elements of the second group.

3. The method of driving the ink jet type printing had as claimed in claim 1, wherein said step (b) sets the predetermined phase difference such that the second driving voltage starts to rise within a time period of T/4 to T/2 from a time when the first driving voltage starts to rise, where T denotes a period of pressure waves generated within the channel.

4. The method of driving the ink jet type printing head as claimed in claim 3, wherein the first group of piezoelectric elements act one very other one of said channels and the second group of piezoelectric elements act on remaining channels, so that each one of said channels driven by the piezoelectric elements of the first group is adjacent to the remaining channels driven by the piezoelectric elements of the second group.

5. The method of driving the ink jet type printing head as claimed in claim 1, wherein the channels extend parallel to each other, the piezoelectric elements vary the volumes of the channels by deforming the channels in a direction perpendicular to longitudinal directions of the channels, and said step (a) applies to the piezoelectric elements, the first driving voltage and second driving voltage having waveforms for constantly maintaining the volumes of the channels in a reduced state when ejecting no ink from corresponding channels.

6. The method of driving the ink jet type printing head as claimed in claim 5, wherein said step (a) applies to the piezoelectric elements corresponding to selected nozzles which are to eject the ink, the first driving voltage and second driving voltage having waveforms such that the volume of each selected channel corresponding to one of the selected nozzles first increases nd thereafter decreases to eject the ink through the selected nozzles.

7. The method of driving the ink jet type printing head as claimed in claim 1, wherein said step (b) increases a rise time of one of the first driving voltage and second driving voltage so as to cancel mutual interference of the nozzles corresponding to the first group of piezoelectric elements and the nozzles corresponding to the second group of piezoelectric elements.

8. The method of driving the ink jet type printing head as claimed in claim 1, wherein said step (b) applies to the piezoelectric elements, the first driving voltage and the second driving voltage which have different pulse waveforms so as to cancel mutual interference of the nozzles corresponding to the first group of piezoelectric elements and the nozzles corresponding to the second group of piezoelectric elements.

9. A method of driving an ink jet type printing head which has a plurality of channels, a plurality of nozzles provided on ends of the channels and a plurality of piezoelectric elements for varying volumes of the channels in response to driving voltages so as to eject ink from each of said plurality of nozzles having a corresponding channel, a volume of which is reduced by a corresponding one of the piezoelectric elements, said method comprising the steps of:

(a) applying a first driving voltage to a first group of piezoelectric elements and a second driving voltage to a second group of piezoelectric elements; and (b) controlling a phase of at least one of the first driving voltage and second driving voltage so that a predetermined phase difference exists between the first driving voltage and the second driving voltage; and wherein said step (b) sets the predetermined phase difference such that the second driving voltage starts to rise within a time period of T/4 to T/2 form a time when the first driving voltage starts to rise, where T denotes a period of pressure waves generated within the channel.

10. The method of driving the ink jet type printing head as claimed in claim 9, wherein said step (b) sets the predetermined phase difference such that the second driving voltage starts to fall within a rise time of the first driving voltage.

11. The method of driving the ink jet type printing head as claimed in claim 9, wherein the first group of piezoelectric elements act on every other one of said channels and the second group of piezoelectric elements act on remaining channels, so that each one of said channels driven by the piezoelectric elements of the first group is adjacent to the remaining channels driven by the piezoelectric elements of the second group.

12. The method of driving the ink jet type printing head as claimed in claim 9, wherein the channels extend parallel to each other, the piezoelectric elements vary the volumes of the channels by deforming the channels in a direction perpendicular to longitudinal directions of the channels, and said step (a) applies to the piezoelectric elements the first driving voltage and second driving voltage having waveforms for constantly maintaining the volumes of the channel in a reduced state when ejecting no ink from corresponding channels.

13. The method of driving the ink jet type printing head as claimed in claim 9, wherein said step (a) applies to the piezoelectric elements corresponding to selected nozzles which are to eject the ink, the first driving voltage and second driving voltage having waveforms such that the volume of each selected channel corresponding to the selected nozzle first increase and thereafter decreases to eject the ink through the selected nozzles.

14. The method of driving the ink jet type printing head as claimed in claim 9, wherein said step (b) increases a rise time of one of the first and second driving voltage so as to cancel mutual interference of the nozzles corresponding to the first group of piezoelectric elements and the nozzles corresponding to the second group of piezoelectric elements.

15. The method of driving the ink jet type printing head as claimed in claim 9, wherein said step (b) applies to the piezoelectric elements the first driving voltage and the second driving voltage which have different pulse waveforms so as to cancel mutual interference of the nozzles corresponding to the first group of piezoelectric elements and ht nozzles corresponding to the second group of piezoelectric elements.

16. An ink jet type printing head comprising:

a plurality of channels, a plurality of nozzles provided on ends of the channels, a plurality of piezoelectric elements for varying volumes of the channels in response to driving voltages so as to eject ink form each of said nozzles having a corresponding channel, a volume of which is reduced by a corresponding one of the piezoelectric elements;

means for applying a first driving voltage to a first group of said plurality of piezoelectric elements and for applying a second diving voltage to a second group of said plurality of piezoelectric elements; and 'mean for controlling a phase of at least one of the first driving voltage and second driving voltage such that the second driving voltage starts to rise within a time period of T/4 to T/2 from a time when the first driving voltage starts to rise, where T denotes a period of pressure waves generated within the channel.

* * * * *